US006190076B1

(12) United States Patent
Yeh

(10) Patent No.: US 6,190,076 B1
(45) Date of Patent: Feb. 20, 2001

(54) DECORATIVE WRITING IMPLEMENT

(76) Inventor: Thomas Yeh, 10F, No.97, Sec.2, Nan-Kang Rd., Taipei (TW)

( * ) Notice: Under 35 U.S.C. 154(b), the term of this patent shall be extended for 0 days.

(21) Appl. No.: 09/339,823

(22) Filed: Jun. 25, 1999

(51) Int. Cl.[7] ..... B43K 23/02
(52) U.S. Cl. ..... 401/131; 401/34; 401/18
(58) Field of Search ..... 401/131, 35, 34, 401/16, 17, 18, 19, 20, 22, 23, 48

(56) References Cited

U.S. PATENT DOCUMENTS 2,297,806 * 10/1942 Smith ..... 401/131
3,510,949 * 5/1970 Christy ..... 401/131
3,638,319 * 2/1972 Barlow et al. ..... 401/48
5,037,224 * 8/1991 Wright ..... 401/48
5,163,549 * 11/1992 Hayduchok ..... 401/131
5,263,259 * 11/1993 Cimador ..... 401/35
6,033,139 * 3/2000 Dutcher ..... 401/35
6,041,507 * 3/2000 Dutcher et al. ..... 401/35

* cited by examiner

*Primary Examiner*—David J. Walczak
(74) *Attorney, Agent, or Firm*—Dougherty & Troxell

(57) ABSTRACT

A decorative writing implement includes an animal-shaped body having four limbs and a head. Each limb is detachable from the body and retains a pen therein. A rear end of each limb is interferentially fit into a hole defined in the body for mounting the limb to the body. A writing tip of each pen extends beyond a front end of the corresponding limb. Protection caps in the form of a pair of gloves and a pair of boots are detachably mounted to the writing tips of the pens for protection thereof. A further pen is retained in the body with a writing tip thereof extending beyond the head. A cap is detachably mounted to the head for covering and protecting the further pen. Preferably, the animal-shaped body is made of rubber thereby being capable to serve as an eraser.

1 Claim, 3 Drawing Sheets

DECORATIVE WRITING IMPLEMENT

BACKGROUND OF THE INVENTION

1. Field of the Invention

The present invention generally relates to a writing implement, and in particular to a writing implement having a decorative figure.

2. Description of the Prior Art

Writing implements, such as pencils, are frequently used in writing and marking. A pencil usually comprises an elongate body in which a graphite core is retained. An eraser is sometimes attached to one end of the pencil. Such an eraser is very small and may be quickly consumed up. U.S. Pat. No. 5,709,491 issued to the present applicant on Jan. 20, 1998 discloses a writing implement having a body made of rubber to serve as an eraser which providing the writing implement with a large eraser for a long term use. The writing implement of the '491 patent has only a regular cylindrical or tubular shape which may not be appealing to the general consumers. In addition, the writing implement of the '491 patent comprises a single pen only which does not provide a user with choice of different pens.

Thus, it is desired to have a writing implement which overcomes the disadvantages of the conventional writing implement.

SUMMARY OF THE INVENTION

Accordingly, an object of the present invention is to provide an appealing writing implement having a decorative appearance.

Another object of the present invention is to provide a writing implement comprising a number of pens detachably mounted thereto.

To achieve the above objects, in accordance with the present invention, there is provided a decorative writing implement comprising an animal-shaped body having four limbs and a head. Each limb is detachable from the body and retains a pen therein. The pens may be different. For example, the pens may be of different colors. A rear end of each limb is interferentially fit into a hole defined in the body for mounting the limb to the body. A writing tip of each pen extends beyond a front end of the corresponding limb. Protection caps in the form of a pair of gloves and a pair of boots are detachably mounted to the writing tips of the pens for protection thereof. A further pen is retained in the body with a writing tip thereof extending beyond the head. A cap is detachably mounted to the head for covering and protecting the further pen. Preferably, the animal-shaped body is made of rubber thereby being capable to serve as an eraser.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
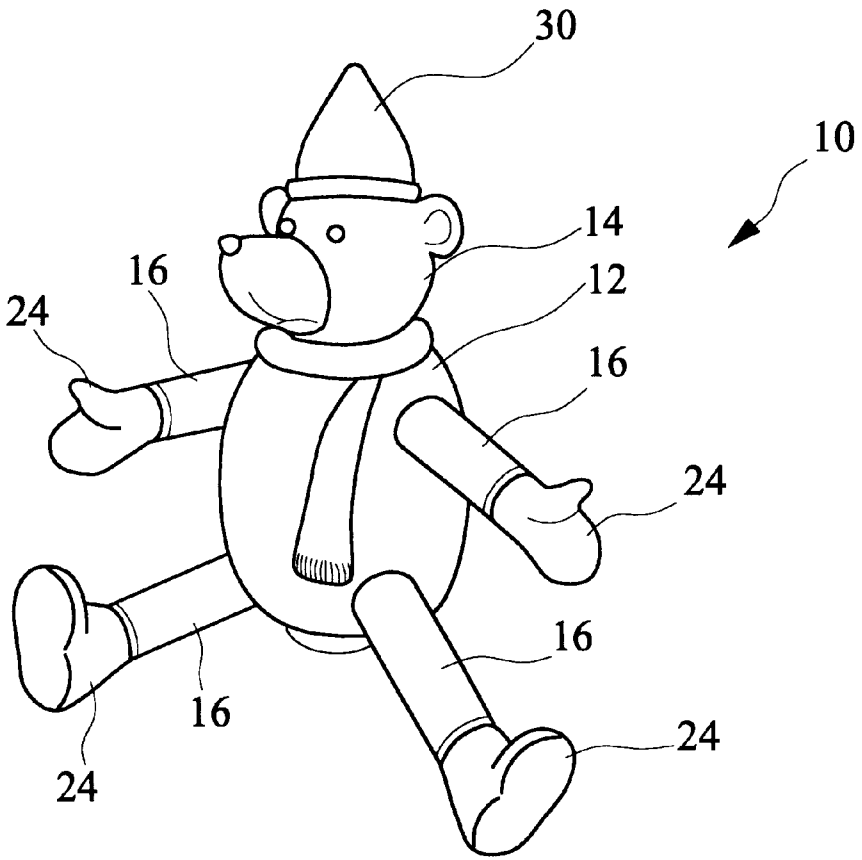
FIG. 1 is a perspective view of a writing implement constructed in accordance with the present invention.

With reference to the drawings and in particular to FIG. 1, wherein a writing implement constructed in accordance with the present invention, generally designated by reference numeral 10, is shown, the writing implement 10 comprises a body 12 and a number of projections 14, 16 extending from the body 12. In accordance with the present invention, the body 12 and the projections 14, 16 are configured as a decorative article, such as a figure or an animal shape, for example a bear, as shown in the drawings. The body 12 serves as the body of the animal while the projections 14, 16 serve as the head and four limbs of the animal.

Preferably, the body 12 and the projections 14, 16 are made of rubber thereby serving as an eraser.

Figure 2:
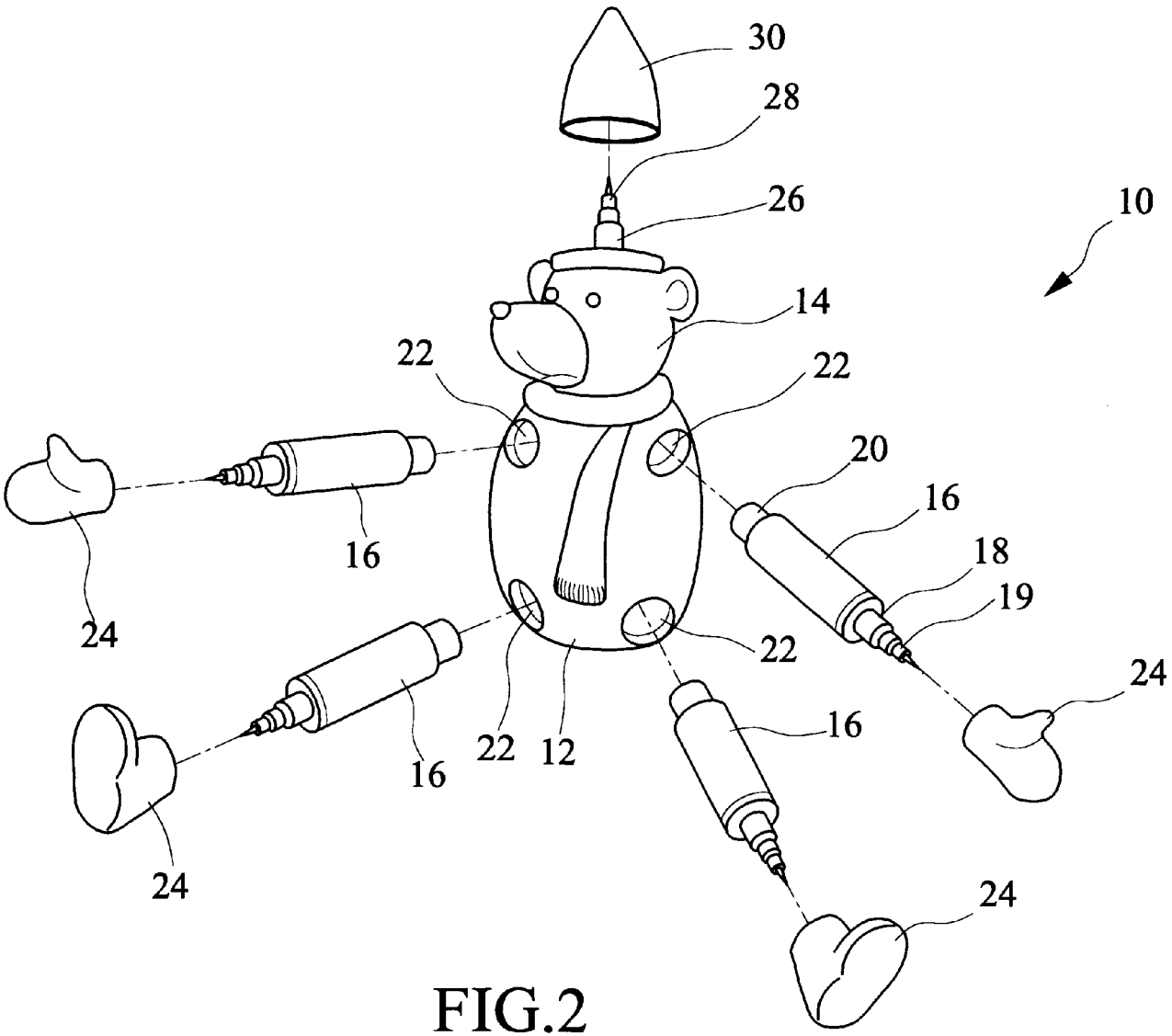
FIG. 2 is an exploded view of a first embodiment of the writing implement in accordance with the present invention.

Referring to FIG. 2, in accordance with a first embodiment of the present invention, each limb 16 comprises a pen 18, or as a pencil, tightly fit into an axial bore (not labeled) of the limb 16. Alternatively, the pen 18 is molded in and thus integrally retained in the limb 16 with a writing tip 19 extending beyond a first end of the limb 16. The limb 16 has an end boss 20 formed on a second end thereof for being tightly/interferentially fit into a corresponding hole 22 deemed in the body 12 to mount the limb 16 to the body 12. A protection cap 24 is detachably fit over the writing tip 19 to cover and protect the writing tip, 19. In the embodiment, the protection cap 24 is made in the form of a glove or a boot for matching the limb 16.

A further pen 26 is received and retained in the body 12 with a writing tip 28 thereof exposed to the top side of the body 12. A protection cap 30 is detachably fit over the writing tip 28 for protection purposes. In the embodiment illustrated, the writing tip 28 extends beyond the head 14 of the animal and the protection cap 30 is a cap worn on the head 14. Alternatively, the head 14 may be made detachable thereby serving as a protection cap of the pen 26.

Figure 3:
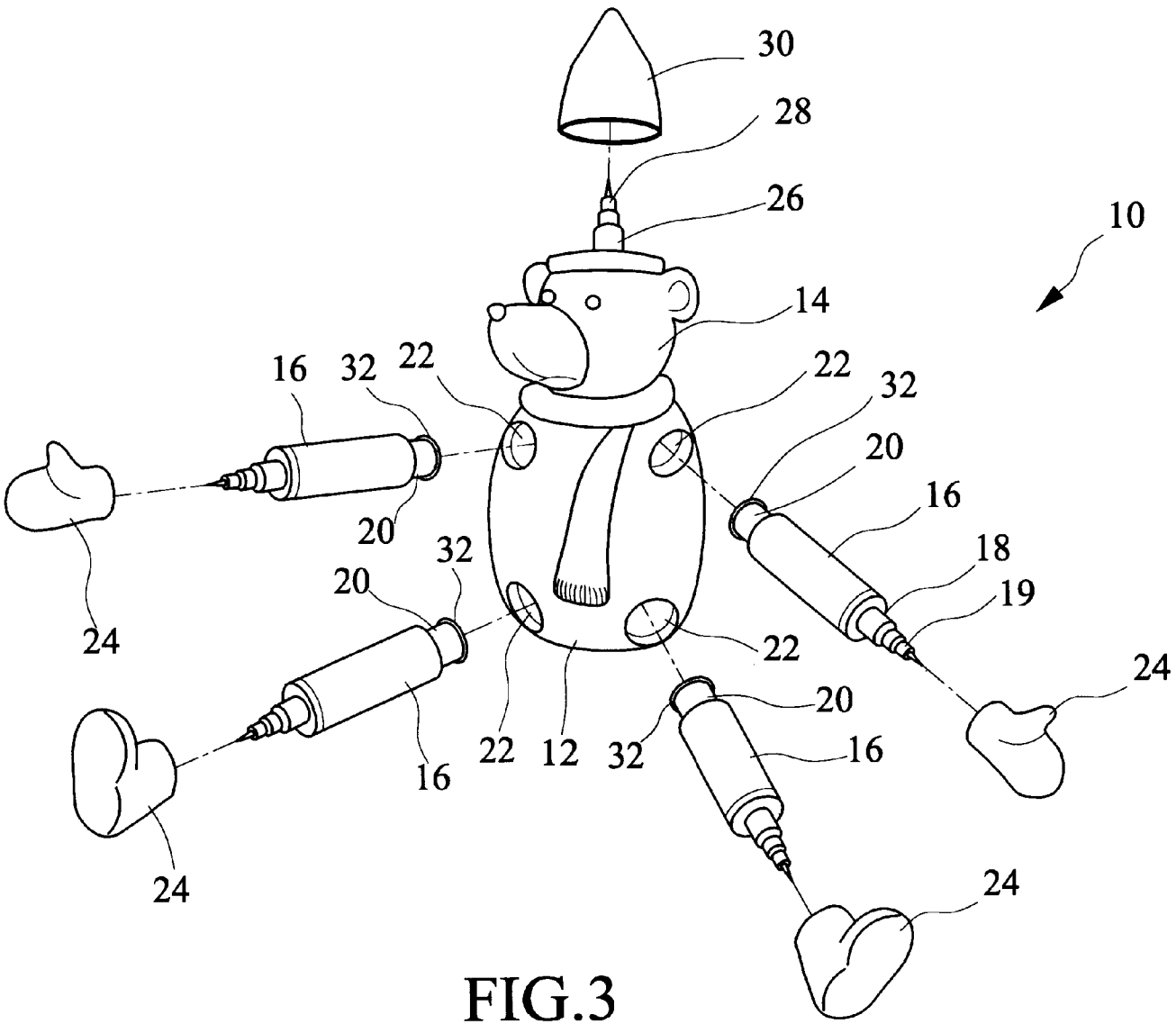
FIG. 3 is an exploded view of a second embodiment of the writing implement in accordance with the present invention.

FIG. 3 shows a second embodiment of the present invention. The second embodiment is substantially similar to the first embodiment except that a circumferential flange 32 is formed on the end boss 20 of each limb 16 for engaging with a corresponding groove (not shown) formed inside the corresponding hole 22 of the body 12 thereby more securely retaining the limb 16 to the body 12.

Although the present invention has been described with respect to preferred embodiments, it is contemplated that a variety of modifications, variations and substitutions may be done without departing from the scope of the present invention that is intended to be defined by the appended claims.

What is claimed is:

1. A writing implement comprising:

a body defining a number of holes; and a plurality of elongate members, each elongate member having a rear end tightly and detachably fit into one of the holes and serving as a projection of the body, a pen retained in and surrounded by each elongate member thereby being detachably mounted to the body; and, wherein each pen has a writing tip extending beyond a front end of the corresponding elongate member for writing purposes and wherein a protection cap is detachably mounted to the front end of at least one of the elongate members to cover and protect the writing tip of the pen wherein the writing implement is configured as an animal having a head and four detachable limbs, the limbs forming the elongate members.

* * * * *